US010665409B1

(12) United States Patent
Worsham

(10) Patent No.: US 10,665,409 B1
(45) Date of Patent: May 26, 2020

(54) WATERPROOF COVER FOR A RESETTABLE IN-LINE FUSE

(71) Applicant: David Worsham, Santa Rosa Beach, FL (US)

(72) Inventor: David Worsham, Santa Rosa Beach, FL (US)

( * ) Notice: Subject to any disclaimer, the term of this patent is extended or adjusted under 35 U.S.C. 154(b) by 0 days.

(21) Appl. No.: 16/134,155

(22) Filed: Sep. 18, 2018

Related U.S. Application Data

(60) Provisional application No. 62/560,520, filed on Sep. 19, 2017.

(51) Int. Cl.
*H01H 71/02* (2006.01)
*H01H 85/30* (2006.01)

(52) U.S. Cl.
CPC ..... *H01H 71/0264* (2013.01); *H01H 71/025* (2013.01); *H01H 85/30* (2013.01); *H01H 2223/002* (2013.01); *H01H 2223/044* (2013.01); *H01H 2239/034* (2013.01)

(58) Field of Classification Search
CPC .. H01R 13/688; H01H 85/04; H01H 85/2015; H01H 85/202; H01H 85/203; H01H 85/22; H01H 71/0264; H01H 71/025
See application file for complete search history.

(56) References Cited

U.S. PATENT DOCUMENTS 2,277,619 A * 3/1942 Wallace ..... H01H 85/38 337/35
2,461,126 A * 2/1949 Overturf ..... H01H 73/30 337/66
2,851,558 A * 9/1958 Linton ..... H01H 85/32 337/195
8,009,010 B2 * 8/2011 Pentell ..... H01H 85/2015 337/186
9,293,272 B1 * 3/2016 Lechner ..... H01H 9/00

* cited by examiner

*Primary Examiner* — Shawn M Braden
(74) *Attorney, Agent, or Firm* — Lanier Ford Shaver & Payne; Gerald M. Walsh

(57) ABSTRACT

A waterproof cover for a resettable in-line fuse having a cover with a top end and a bottom end; a seal mount on the top end; and a flexible seal for the seal mount. The seal mount has a hollow interior and an annular flange. The flexible seal has a top portion, a middle portion, and bottom portion. A translucent flexible dome is positioned on the top portion and an internal annular groove is positioned in the middle portion to engage the annular flange. A seal is positioned in the bottom end of the cover and positioned around a female section of the resettable in-line fuse. A seal is also positioned in a bottom end of the female section of the resettable in-line fuse to produce a waterproof fuse. A reset button is visible in the translucent flexible dome when the resettable in-line fuse is tripped. The fuse can be reset by pushing the flexible dome against the reset button.

8 Claims, 5 Drawing Sheets

WATERPROOF COVER FOR A RESETTABLE IN-LINE FUSE

CROSS-REFERENCE TO RELATED APPLICATIONS

This application claims priority to U.S. Provisional Application No. 62/560,520 filed on Sep. 19, 2017, the contents of which are incorporated herein by reference.

FIELD OF THE INVENTION

This invention relates to covers for fuses and, more particularly, to a waterproof cover for a resettable in-line fuse.

BACKGROUND OF THE INVENTION

In-line fuses have a replaceable fuse with a cover. The fuse will melt and break with excessive electrical current. In order to restore function to the fuse it is necessary to remove a cover over the fuse, replace the fuse, and then replace the cover. Sometimes it is necessary to remove the covers of several fuses to see which one has the break. In this regard, these types of waterproof fuses are inconvenient. What is needed is a resettable in-line fuse that is easy to identify when tripped and easy to reset.

SUMMARY OF THE INVENTION

This invention provides a waterproof cover for a resettable in-line fuse having a cover with a top end and a bottom end; a seal mount on the top end; and a translucent seal to seal the seal mount, wherein a reset button is visible in the translucent seal when the resettable in-line fuse is tripped. The seal mount has a hollow interior and an annular flange. The translucent seal has a top portion, a middle portion, and bottom portion. A flexible dome is positioned on the top portion and an internal annular groove is positioned in the middle portion. A bottom seal is positioned in the bottom end of the cover and is positioned around a female section of the resettable in-line fuse. The reset button of the resettable in-line fuse is positioned in the hollow interior of the seal mount and is visible in the flexible dome when the resettable in-line fuse is tripped. The resettable in-line fuse is reset when the flexible dome is pushed. The annular flange is positioned in the internal annular groove in the middle portion of the translucent seal, thereby sealing the seal mount.

An advantage of the waterproof cover of the present invention is a flexible translucent dome to visualize the reset button when the fuse is tripped.

Another advantage is a flexible translucent dome that can be pushed to reset the fuse.

Another advantage are seals on the top end and bottom end of the cover and on the bottom end of the female section of the resettable in-line fuse to render the fuse waterproof.

Another advantage is the ability to identify the fuse in a tripped condition and to reset it without having to open and inspect the fuse.

DESCRIPTION OF THE INVENTION

Figure 1:
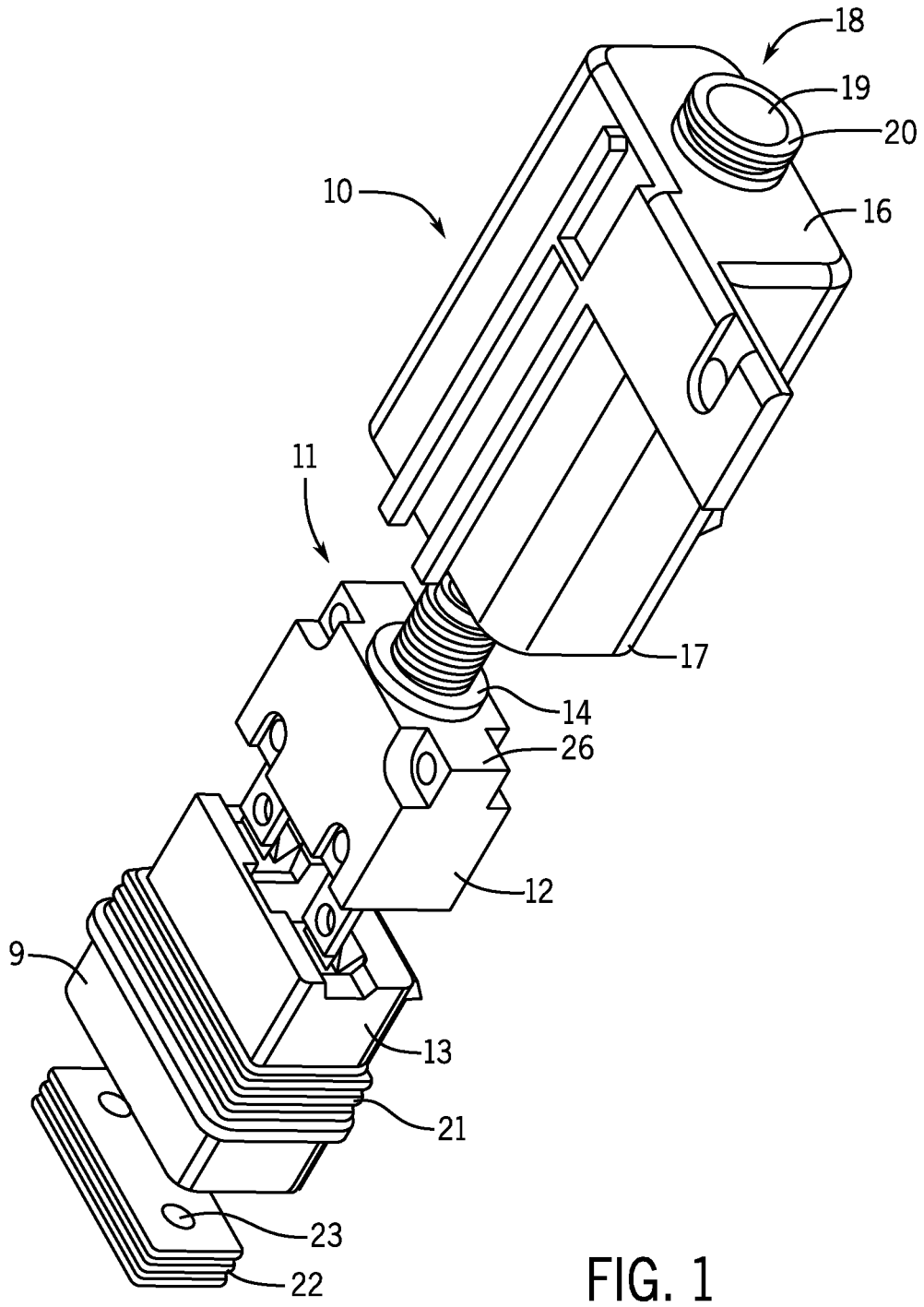
FIG. 1 is a top, side, perspective exploded view of a waterproof cover of the present invention and a resettable in-line fuse.
Figure 2:
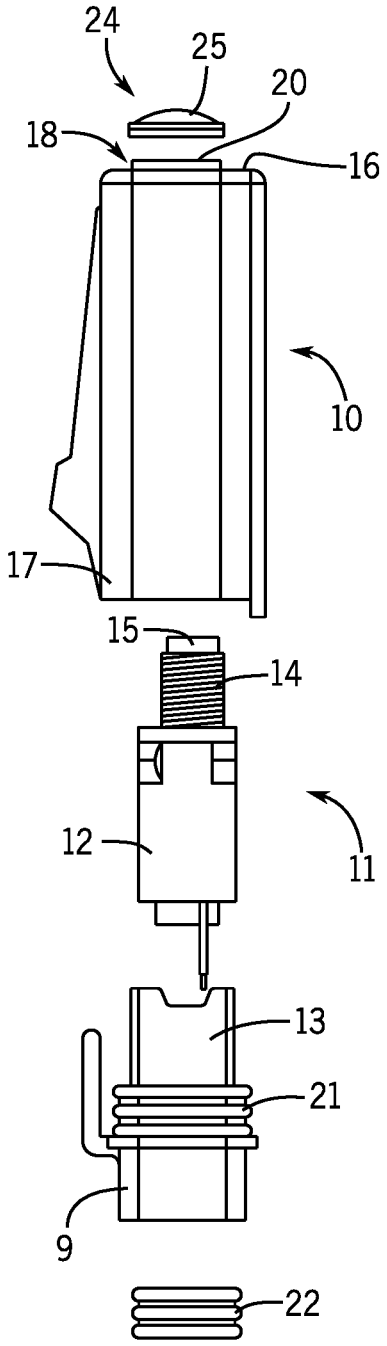
FIG. 2 is a side elevation exploded view of a waterproof cover and a resettable in-line fuse.
Figure 3:
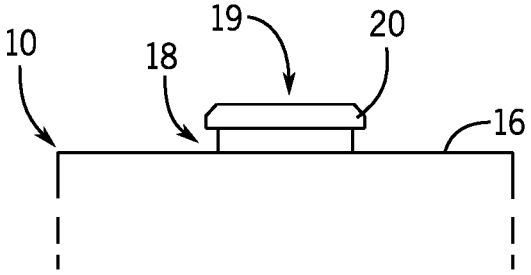
FIG. 3 is an enlarged view of a seal mount on a top end of the waterproof cover.

FIG. 1 shows a top, side, perspective exploded view of a waterproof cover 10 for a resettable in-line fuse 11. The in-line fuse 11 has a male section 12 (fuse section) and a female section 13, as is known in the art. The male section 12 has an upward extension 14 on a top end 26 having a reset button 15 therein (see FIG. 2). The waterproof cover 10 has a top end 16 and a bottom end 17. A seal mount 18 is positioned on the top end 16. The seal mount 18 has a hollow interior 19 and an annular seal mount flange 20. The bottom end 17 has a waterproof seal 21 which is positioned around the female section 13. Seal 22 is positioned in a bottom end 9 of the female section 13 and has openings 23 for the passage of electrical wires, as is known in the art. FIG. 2 shows a side elevation exploded view of the waterproof cover 10 for the resettable in-line fuse 11. FIG. 2 further shows the reset button 15 protruding from the upward extension 14. FIG. 2 also shows a translucent flexible seal 24 having a dome 25. The translucent flexible seal 24 is reversibly attachable to the seal mount 18 by means of the annular seal mount flange 20. FIG. 3 is an enlarged view of a seal amount 18 on the top end 16 of the waterproof cover 10.

Figure 4:
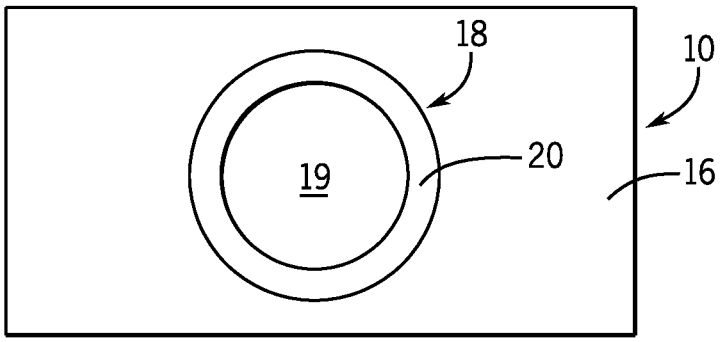
FIG. 4 is a top view of the waterproof cover and the seal mount.
Figure 5:
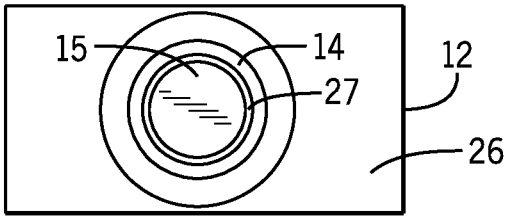
FIG. 5 is a top view of a male portion of the resettable in-line fuse showing a reset button.
Figure 6:
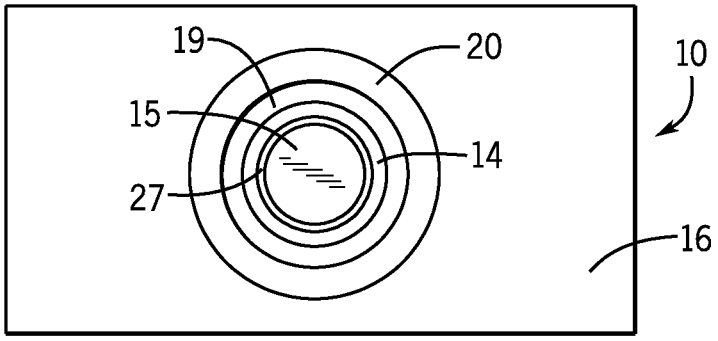
FIG. 6 is a top view of the reset button positioned in the seal mount of the waterproof cover.

FIG. 4 shows a top view of the waterproof cover 10 and the seal mount 18. FIG. 5 shows the top end 26 of a male section 12 of the resettable in-line fuse 11, showing the reset button 15 in an interior 27 of the upward extension 14. FIG. 6 shows a top view of the upward extension 14 and reset button 15 positioned in the seal mount 18 of the waterproof cover 10.

Figure 7:
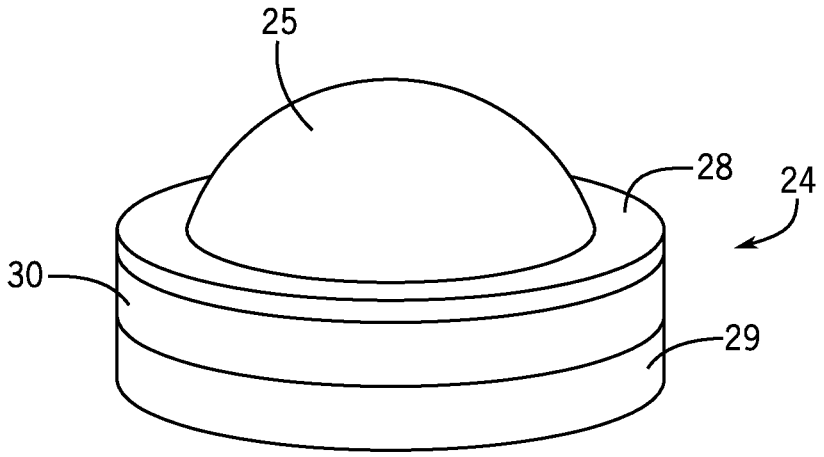
FIG. 7 is a top, side, perspective view of a waterproof translucent flexible seal that fits over the seal mount.
Figure 8:
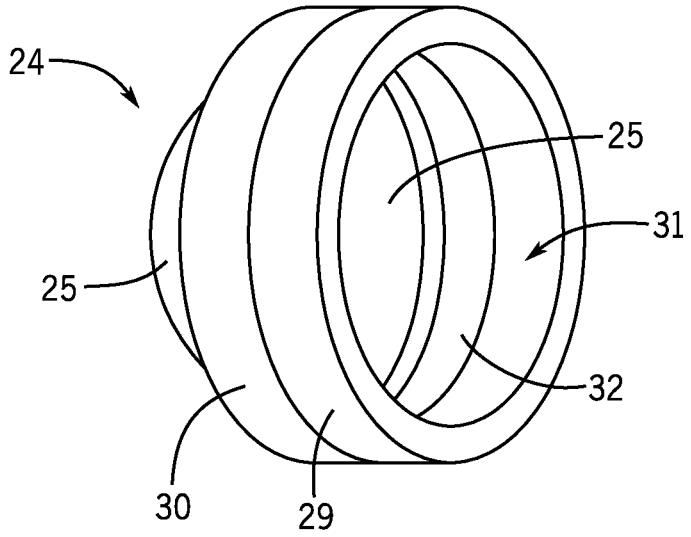
FIG. 8 is a side, perspective view of an interior of the waterproof translucent flexible seal.

FIG. 7 shows a top, side, perspective view of the waterproof translucent flexible seal 24 that fits over flange 20 the seal mount 18. The waterproof translucent flexible seal 24 has a top portion 28 and a bottom portion 29 with a middle portion 30 therebetween. A dome 25 is positioned on the top portion 28. FIG. 8 shows a side, perspective view of an interior 31 of the waterproof translucent flexible seal 24. Also shown in FIG. 8 is an internal annular groove 32 in an interior side of the middle portion 30. The waterproof translucent flexible seal 24 can be pressed over the flange 20 of the seal mount 18 and fastened reversibly thereto as the annular seal mount flange 20 enters into the annular groove 32. The waterproof translucent flexible seal 24 and the cover seal 21, render the resettable in-line fuse 11 waterproof.

Figure 9:
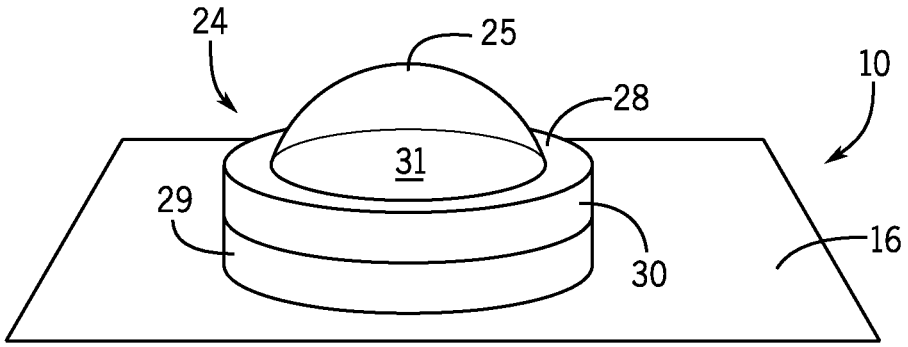
FIG. 9 is a top view of the waterproof translucent flexible seal attached to the seal mount.

FIG. 9 shows a top perspective view of the waterproof translucent flexible seal 24 attached to the seal mount 18.

Figure 10:
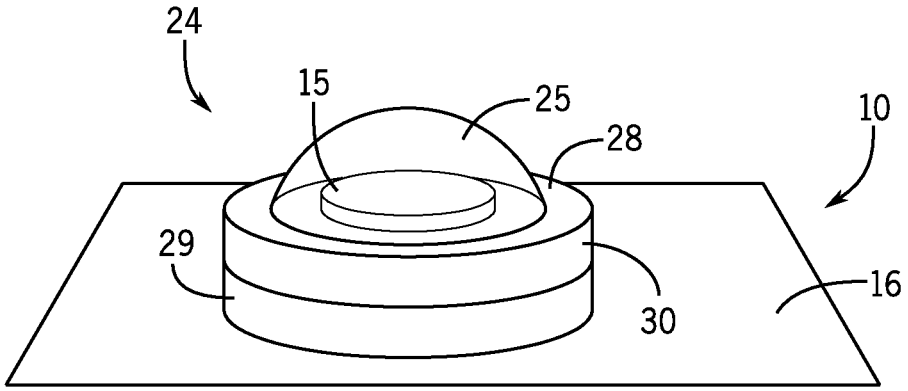
FIG. 10 is a top perspective view of the waterproof translucent flexible seal attached to the seal mount with the reset button positioned in dome of the seal.

FIG. 10 is a top view of the waterproof translucent flexible seal 24 attached to the seal mount 18 with the reset button 15 positioned in the waterproof translucent flexible seal 24. When a power surge trips the male section 12 to break an electrical connection therein, the reset button 15 is pushed so as to move further out of the upward extension 14 of the male section 12 and into the interior 31 of the waterproof translucent flexible seal 24. In this configuration the reset button 15 is clearly visible in the dome 25 which indicates that the fuse has been tripped. Because the dome 25 is flexible the reset button 15 can be pushed inward into the upward extension 14 which causes the male section 12 to be reset and, thus, conduct electrical current.

The water proof cover of this invention provides a mechanism for rendering a resettable in-line fuse waterproof and the ability to identify the fuse in a tripped condition and to reset it without having to open and inspect the fuse.

The foregoing description has been limited to specific embodiments of this invention. It will be apparent, however, that variations and modifications may be made by those skilled in the art to the disclosed embodiments of the invention, with the attainment of some or all of its advantages and without departing from the spirit and scope of the present invention. For example, the flexible seal with a translucent dome can be made of any suitable plastic. The cover can be made of any suitable plastic or metal and in various sizes and shapes. The waterproof cover can be used with any type of resettable fuse that uses a reset button.

It will be understood that various changes in the details, materials, and arrangements of the parts which have been described and illustrated above in order to explain the nature of this invention may be made by those skilled in the art without departing from the principle and scope of the invention as recited in the following claims.

The invention claimed is:

1. A waterproof cover for a resettable in-line fuse comprising:

a) a cover having a top end and a bottom end;

b) a seal mount on the top end;

c) a translucent seal to seal the seal mount, wherein a reset button is visible in the translucent seal when the resettable in-line fuse is tripped;

d) the seal mount having a hollow interior and an annular flange; and e) the translucent seal having a top portion, a middle portion, and bottom portion, wherein a flexible dome is positioned on the top portion and an internal annular groove is positioned in the middle portion and wherein the annular flange is positioned in the internal annular groove in the middle portion of the translucent seal, thereby sealing the seal mount.

2. The waterproof cover of claim 1, further comprising a seal that is positioned in the bottom end of the cover and is constructed to fit around a female section of the resettable in-line fuse.

3. The waterproof cover of claim 1, wherein the reset button of the resettable in-line fuse is positioned in the hollow interior of the seal mount and is visible in the flexible dome when the resettable in-line fuse is tripped and wherein the resettable in-line fuse is reset when the flexible dome is pushed.

4. The waterproof cover of claim 1, further comprising a seal that is positioned in a bottom end of a female section of the resettable in-line fuse.

5. A waterproof cover for a resettable in-line fuse comprising:

a) a cover having a top end and a bottom end;

b) a seal mount on the top end;

c) a translucent seal to seal the seal mount, wherein a reset button is visible in the translucent seal when the resettable in-line fuse is tripped;

d) the seal mount having a hollow interior and an annular flange;

e) the translucent seal having a top portion, a middle portion, and bottom portion, wherein a flexible dome is positioned on the top portion and an internal annular groove is positioned in the middle portion and wherein the annular flange is positioned in the internal annular groove in the middle portion of the translucent seal, thereby sealing the seal mount; and f) a seal positioned in the bottom end of the cover and positioned around a female section of the resettable in-line fuse.

6. The waterproof cover of claim 5, wherein the reset button of the resettable in-line fuse is positioned in the hollow interior of the seal mount and is visible in the flexible dome when the resettable in-line fuse is tripped and wherein the resettable in-line fuse is reset when the flexible dome is pushed.

7. The waterproof cover of claim 5, further comprising a seal that is positioned in a bottom end of the female section of the resettable in-line fuse.

8. A waterproof cover for a resettable in-line fuse comprising:

a) a cover having a top end and a bottom end;

b) a seal mount on the top end;

c) a translucent seal to seal the seal mount, wherein a reset button is visible in the translucent seal when the resettable in-line fuse is tripped;

d) the seal mount having a hollow interior and an annular flange;

e) the translucent seal having a top portion, a middle portion, and bottom portion, wherein a flexible dome is positioned on the top portion and an internal annular groove is positioned in the middle portion;

f) a seal positioned in the bottom end of the cover and positioned around a female section of the resettable in-line fuse; and g) a seal that is positioned in a bottom end of the female section of the resettable in-line fuse, wherein the reset button of the resettable in-line fuse is positioned in the hollow interior of the seal mount and is visible in the flexible dome when the resettable in-line fuse is tripped, wherein the resettable in-line fuse is reset when the flexible dome is pushed, and wherein the annular flange is positioned in the internal annular groove in the middle portion of the translucent seal, thereby sealing the seal mount.

* * * * *